United States Patent [19]

Lageder et al.

[11] Patent Number: 4,802,403

[45] Date of Patent: Feb. 7, 1989

[54] RETURN MECHANISM OF AN ACTUATING DRIVE

[75] Inventors: Heinrich Lageder, Siggenthal-Sation; Jaroslav Masek, Wettingen; Kamil Prochazka, Windisch, all of Switzerland

[73] Assignee: BBC Brown, Boveri & Company, Ltd., Baden, Switzerland

[21] Appl. No.: 910,680

[22] Filed: Sep. 23, 1986

[30] Foreign Application Priority Data

Oct. 2, 1985 [DE] Fed. Rep. of Germany ..... 3535174

[51] Int. Cl.[4] ..... F15B 9/10

[52] U.S. Cl. ..... 91/374; 91/382

[58] Field of Search ..... 91/382, 384, 410, 368, 91/374, 379

[56] References Cited

U.S. PATENT DOCUMENTS

| | | | |
|---|---|---|---|
| 2,610,614 | 9/1952 | Sedgwick | 91/382 |
| 3,040,715 | 6/1962 | McCombs | 91/382 |
| 3,264,947 | 8/1966 | Bidlack | 91/384 |
| 4,227,441 | 10/1980 | Prochazka | 91/382 |

FOREIGN PATENT DOCUMENTS

| | | | |
|---|---|---|---|
| 929996 | 7/1955 | Fed. Rep. of Germany . | |
| 2203033 | 5/1974 | France . | |
| 97717 | 6/1921 | Switzerland | 91/382 |

OTHER PUBLICATIONS

Ölhydraulik und Pneumatik, 12(1968) Nr. 11, pp. 527–538 (German publication).

*Primary Examiner*—Edward K. Look

*Attorney, Agent, or Firm*—Burns, Doane, Swecker & Mathis

[57] ABSTRACT

In an actuating drive for valves, the stroke motion of the servo piston has to be transmitted to the return sleeve in the control block, so that this results in that hydraulic feedback which restores the equilibrium at the servo piston. By means of a lever or a single-point mounting, this same stroke motion is directly transmitted to a pin attached in an eccentric position relative to the center axis of the return sleeve and transmitted from this pin to the return sleeve adjoining thereunder.

1 Claim, 1 Drawing Sheet

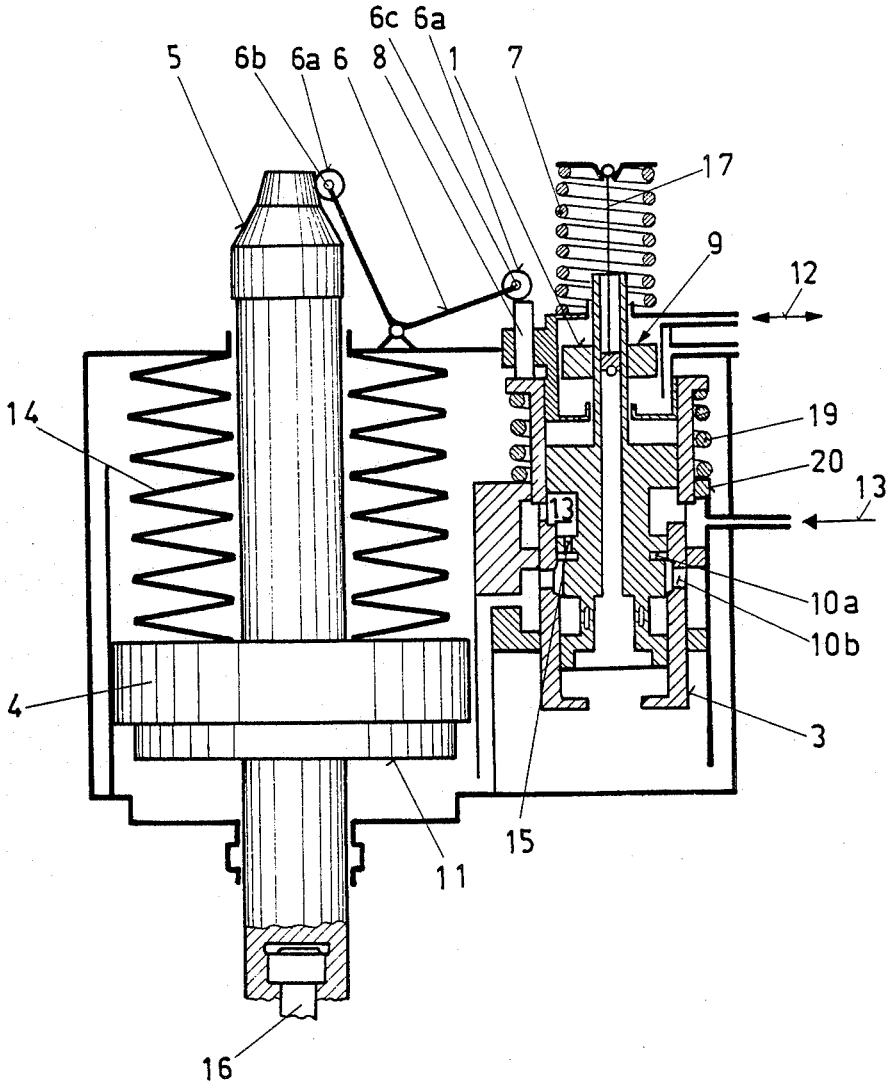
6c
6a
5
6b
6a
6
8
1
7
17
9
12
14
19
20
13
13
10a
10b
4
3
15
11
16

RETURN MECHANISM OF AN ACTUATING DRIVE

BACKGROUND OF THE INVENTION

1. Field of the Invention

The present invention relates to a return mechanism of an actuating drive.

2. State of the Art

The function of a return mechanism of an actuating drive for valves is to transmit a motion of the servo piston to a return sleeve in a control block. When hydraulic pressure acting on the servo piston rises or drops, the servo piston executes a stroke motion in one direction, the length of which is information variable for the transmission mechanism acting on the return sleeve in the control block inasmuch as the displacement of the return sleeve always triggers a hydraulic feedback which restores the equilibrium in the servo piston.

It is known to transmit stroke motion of a servo piston to a return sleeve in a control block by a series of linkages, connecting links and eccentric disks.

The disadvantages of known embodiments are that, inaccuracies cannot be prevented from occurring in the transmission of the stroke motion of the servo piston to the return sleeve, whether on account of kinematic friction losses or because of bearing play in the linkages or because of the inherent risk of jamming of the transmission mechanism itself. It can therefore be said that the designs provided in the prior art are unable to provide a satisfactory solutions to the problem of transmitting stroke motion of the servo piston to the return sleeve—without time-lag, without mechanical fault and without inaccuracies in stroke lengths. All of these shortcomings can cause errors which can have an effect on controllability.

SUMMARY AND OBJECTS OF THE INVENTION

Here, the invention is intended to provide corrective measures. The object of the present invention is to ensure that, in a return mechanism, the stroke motion of the servo piston is transmitted reliably and directly to the return sleeve.

An essential advantage of the invention is that the stroke motion of the servo piston is transmitted directly to the return sleeve simply via a lever on a single-point mounting. Thus specific transmission errors and time-lags are eliminated.

Various advantages of the present invention can be readily ascertained from the following description and appended drawing.

BRIEF DESCRIPTION OF THE DRAWING

An exemplary embodiment of the invention is described below with reference to the drawing labelled FIG. 1.

The single figure shows an actuating drive for valves, having a built-in return mechanism which transmits the stroke motion of the servo piston to the return sleeve.

All elements which are not required for the direct understanding of the invention have been omitted. The flow direction of the medium is indicated by arrows.

DETAILED DESCRIPTION OF THE PREFERRED EMBODIMENT

At every equilibrium position of the actuating drive, as is apparent from the figure, a constant control pressure acts on the control surface 9 of the slide valve 1. The force developed on control surface 9 is in equilibrium with the spring force of the control spring 7. In this configuration, the slide valve 1 does not move. The servo piston 4 is shown in the position in which the inflow (not shown) of servo fluid to the piston face 11 remains closed, with the lever 6, which is actuated via the connecting link 5, positioning the return sleeve 3. The force is transmitted between the lever 6 and the return sleeve 3 via a pin 8 which is attached in an eccentric position relative to the center axis of the return sleeve 3. The control edges **10*a* and 10*b* of the slide valve 1 and the return sleeve 3, respectively, assume a position relative to one another which is in conformity with the pressure required for the equilibrium of the forces at the servo piston 4. During an opening or closing operation, the control pressure 12 is increased or reduced by a differential amount. The increase or reduction in the hydraulic force on the control surface 9 leads to the equilibrium at the slide valve 1 being interrupted. The slide valve 1 then executes a partial stroke, so that a new equilibrium develops as a result of the increase or reduction in the force from the control spring 7**.

In the opening or closing direction, the control edges **10*a* and 10*b* are open toward the hydraulic pressure 13 or its outflow. The pressure on the piston face 11 rises or drops, as a result of which the state of equilibrium at the servo piston 4 is interrupted: the disk spring stack 14 is compressed or relaxes. As a result of the displacement in length of the servo piston 4 caused by this, the return sleeve 3, because of the spring 19, assumes a new position via the return mechanism 5, 6, and 8 respectively. The maximum possible opening speed of the servo piston 4 is determined by the size of the builtin, non-adjustable diaphragm 15. On the other hand, the maximum closing speed which can be achieved is given by the force of the built-in disk spring stack 14. The motion of the servo piston 4 stops as soon as the return sleeve 3 has executed the same stroke as slide valve 1. A new position of equilibrium is assumed. The pressure on the piston face 11 now corresponds to the new force conditions, that is, the new disk spring force and the new vapor force, determined by the valve stroke, on the valve spindle 16. A tie rod 17 makes the connection between the slide valve 1 and the control spring 7. The spring-mounting of the return sleeve 3 relative to the support 20, as a result of the spring 19, permits a definite position of the return sleeve 3. Accordingly, it is the function of the return mechanism 5, 6 and 8 of the actuating drive to transmit the motion of the servo piston 4 to the return sleeve 3 in the control block according to a certain leverage. Moreover, the change in length of the piston stroke is determined on the one hand by the selected leverage of the lever 6 and on the other hand by the geometry of the connecting link 5, with one lever end 6*b* tracing the relative length displacement of the servo piston 4, and the other lever end 6*c* fully transmitting the resultant length to the return sleeve 3. During this procedure, the motion of the lever 6 is transmitted directly to the return sleeve 3 by means of a pin 8 mounted in an eccentric position relative to the center axis of the return sleeve 3. Tilting can be eliminated by particular attention being paid to the guidance of the pin 8 in the housing of the control slide valve 1. Disks 6a connected to the lever 6 serve as contact locations between the lever 6 and the connecting link 5 and the pin 8**, as a result of which even relatively "sharp" changes in the opening characteristic can be transmitted directly and accurately.

While this invention has been described in accordance with a preferred embodiment of the invention, it is recognized that variations and changes may be made therein without departing from the invention as set forth in the claims.

What in claimed is:

1. A return apparatus of an actuating drive for valves wherein the actuating drive includes a control block having a slide valve and a return sleeve, and a servo-piston, the return apparatus comprising:

a shaped connecting surface provided on the servo-piston;

linearly translatable transmission means for acting on the return sleeve to displace the sleeve in response to a displacement of the servo-piston, said linearly translatable transmission means including a pin supported for linear movement in a direction parallel to and offset from the axis of the return sleeve;

a lever pivotally mounted for rotation about a pivot axis extending in a direction generally perpendicular to the central axis of the servo-piston, said lever including a first lever arm having first follower means for contacting said shaped connecting surface and a second lever arm having second follower means for contacting said linearly translatable transmission means, said first and second follower means including rotatable disks mounted to said first and second arms of said lever, said first disk being in rolling contact with said shaped connecting surface of the servo-piston and said second disk being in rolling contact with said return sleeve; and a control spring positioned colinear with the axis of the return sleeve at a first end of the return sleeve, said transmission means also acting on said first end of the return sleeve.

* * * * *